US005088644A

United States Patent [19]

Scott

[11] Patent Number: 5,088,644

[45] Date of Patent: Feb. 18, 1992

[54] MAILBOX APPARATUS

[76] Inventor: James Scott, 2330 Valleywood SE. Apt. K-9, Grand Rapids, Mich. 49546

[21] Appl. No.: 714,556

[22] Filed: Jun. 13, 1991

[51] Int. Cl.[5] ..... B65D 91/00

[52] U.S. Cl. ..... 232/17; 232/30; 232/35; 104/177

[58] Field of Search ..... 232/17, 30, 35; 104/177, 178, 183; 198/750

[56] References Cited

U.S. PATENT DOCUMENTS

| | | | |
|---|---|---|---|
| 810,806 | 1/1906 | Pier | 232/34 |
| 986,011 | 3/1911 | Kinney | 104/177 |
| 1,113,451 | 10/1914 | Levasseur et al. | 104/177 |
| 1,205,065 | 11/1916 | Weathers | 104/177 |
| 1,260,877 | 3/1918 | Cunningham | 104/177 |
| 1,286,144 | 11/1918 | Tauber | 104/177 |
| 1,457,655 | 6/1923 | Daniel | 104/177 |
| 2,845,217 | 7/1958 | Jacques | 232/17 |
| 3,603,264 | 9/1971 | Arx | 104/183 |
| 3,677,422 | 6/1972 | Meyers et al. | 232/1 R |
| 3,891,139 | 6/1975 | Redling | 232/17 |

*Primary Examiner*—Gary L. Smith
*Assistant Examiner*—Michael J. Milano
*Attorney, Agent, or Firm*—Leon Gilden

[57] ABSTRACT

A conduit member includes a forward first, second, and rear second section connected by a "U" shaped central section to transport a vehicle member between the forward and rear sections about a track utilizing a pulley system to effect reciprocation of the vehicle member within the conduit member. The vehicle member includes a bottom cavity for receiving newspapers therewithin aligned with a lower slot within a forward wall of the forward section. An upper mail cavity is mounted within the vehicle aligned with an upper door for receiving mail therewithin. A cam track mounted upon the vehicle effects reciprocation of an indicator flag within the forward section to provide visual indication of mail to be picked up by an associated mail carrier.

4 Claims, 6 Drawing Sheets

MAILBOX APPARATUS

BACKGROUND OF THE INVENTION

1. Field of the Invention

The field of invention relates to mailbox apparatus, and more particularly pertains to a new and improved mailbox apparatus wherein the same is arranged for remote transport of mail relative to a dwelling.

2. Description of the Prior Art

Various mailbox apparatus has been utilized in the prior art to accommodate inclement weather, wherein an individual utilizes a specialized mailbox apparatus to assist in the positioning and removal of mail relative thereto. For example, U.S. Pat. No. 2,845,217 to Jacques sets forth a newspaper delivery receptacle arranged for retrieving a newspaper from a remote orientation relative to a dwelling utilizing a tether line.

U.S. Pat. No. 3,982,690 to Krizan, et al. sets forth a mailbox container wherein a mailbox hamper is removably mounted therefrom.

U.S. Pat. No. 2,781,964 to Ledgerwood sets forth a mailbox structure wherein telescoping sections are arranged for positioning mail and its containment within the mailbox housing.

U.S. Pat. No. 4,600,143 to Harlow, Jr., et al. sets forth a mailbox utilizing a slidable tray insert slidably mounted relative to an interior compartment of the mailbox.

U.S. Pat. No. 4,821,952 to Deciutiis sets forth a mailbox that is retracted relative to a support framework to indicate positioning of mail therewithin.

As such, it may be appreciated that there continues to be a need for a new and improved mailbox apparatus as set forth by the instant invention which addresses both the problems of ease of use as well as effectiveness in construction in permitting deposit and retrieval of mail relative to a remotely oriented mailbox location, and in this respect, the present invention substantially fulfills this need.

SUMMARY OF THE INVENTION

In view of the foregoing disadvantages inherent in the known types of mailbox apparatus now present in the prior art, the present invention provides a mailbox apparatus wherein the same utilizes a conveyor tube enclosing a delivery vehicle therewithin to effect removal and deposit of mail relative to a remotely oriented mailbox housing. As such, the general purpose of the present invention, which will be described subsequently in greater detail, is to provide a new and improved mailbox apparatus which has all the advantages of the prior art mailbox apparatus and none of the disadvantages.

To attain this, the present invention provides a conduit member including a forward first, second and rear section connected by a "U" shaped central section to transport a vehicle member between the forward and rear sections about a track utilizing a pulley system to effect reciprocation of the vehicle member within the conduit member. The vehicle member includes a bottom cavity for receiving newspapers therewithin aligned with a lower slot within a forward wall of the forward section. An upper mail cavity is mounted within the vehicle aligned with an upper door for receiving mail therewithin. A cam track mounted upon the vehicle effects reciprocation of an indicator flag within the forward section to provide visual indication of mail to be picked up by an associated mail carrier.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved mailbox apparatus which has all the advantages of the prior art mailbox apparatus and none of the disadvantages.

It is another object of the present invention to provide a new and improved mailbox apparatus which may be easily and efficiently manufactured and marketed.

It is a further object of the present invention to provide a new and improved mailbox apparatus which is of a durable and reliable construction.

An even further object of the present invention is to provide a new and improved mailbox apparatus which is susceptible of a low cost of manufacture with regard to both materials and labor, and which accordingly is then susceptible of low prices of sale to the consuming public, thereby making such mailbox apparatus economically available to the buying public.

Still yet another object of the present invention is to provide a new and improved mailbox apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is an orthographic partial cross-sectional illustration of the forward section and vehicle member contained therewithin.

DESCRIPTION OF THE PREFERRED EMBODIMENT

Figure 1:
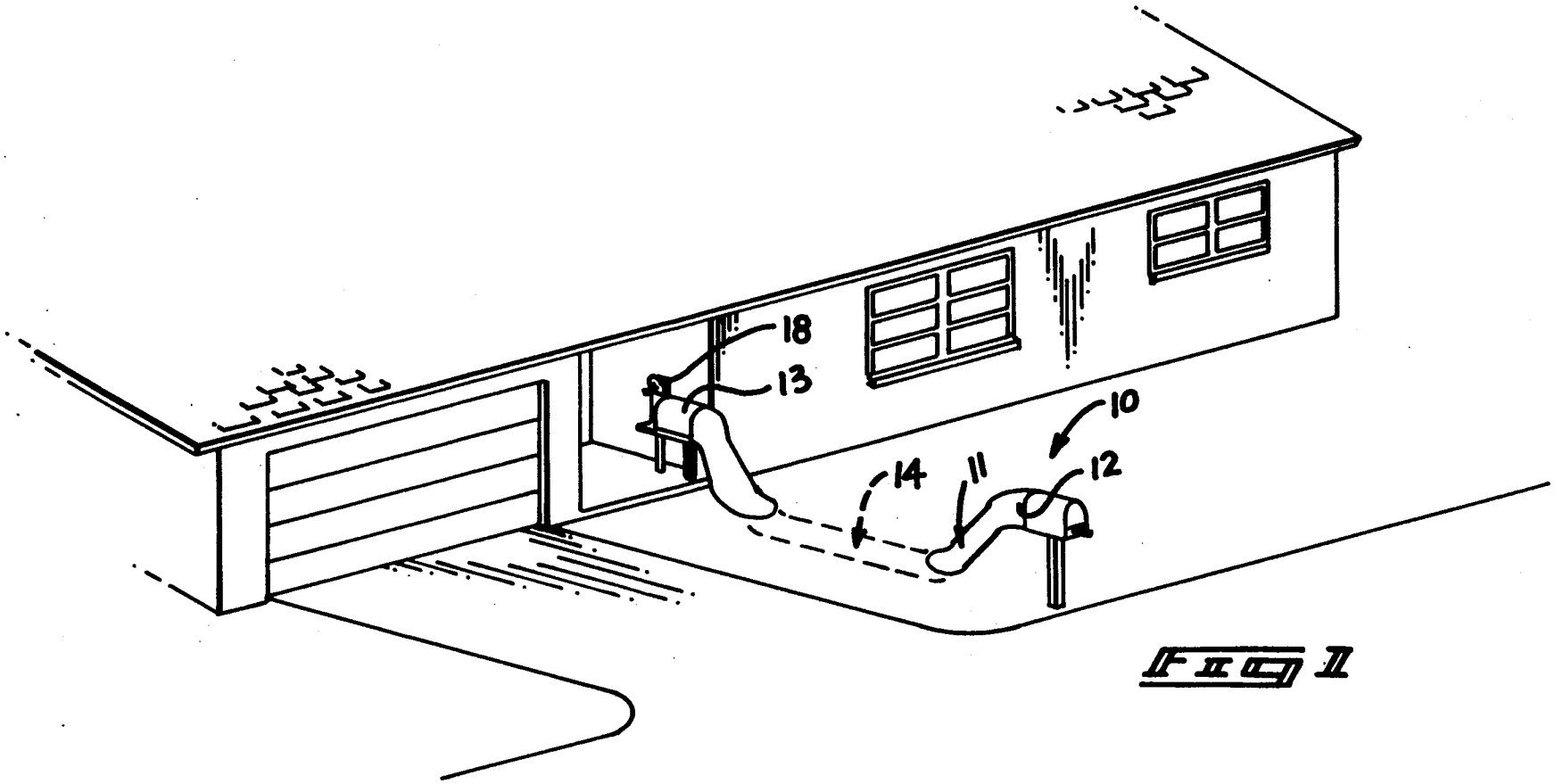
FIG. 1 is an isometric illustration of the invention relative to a dwelling.
Figure 2:
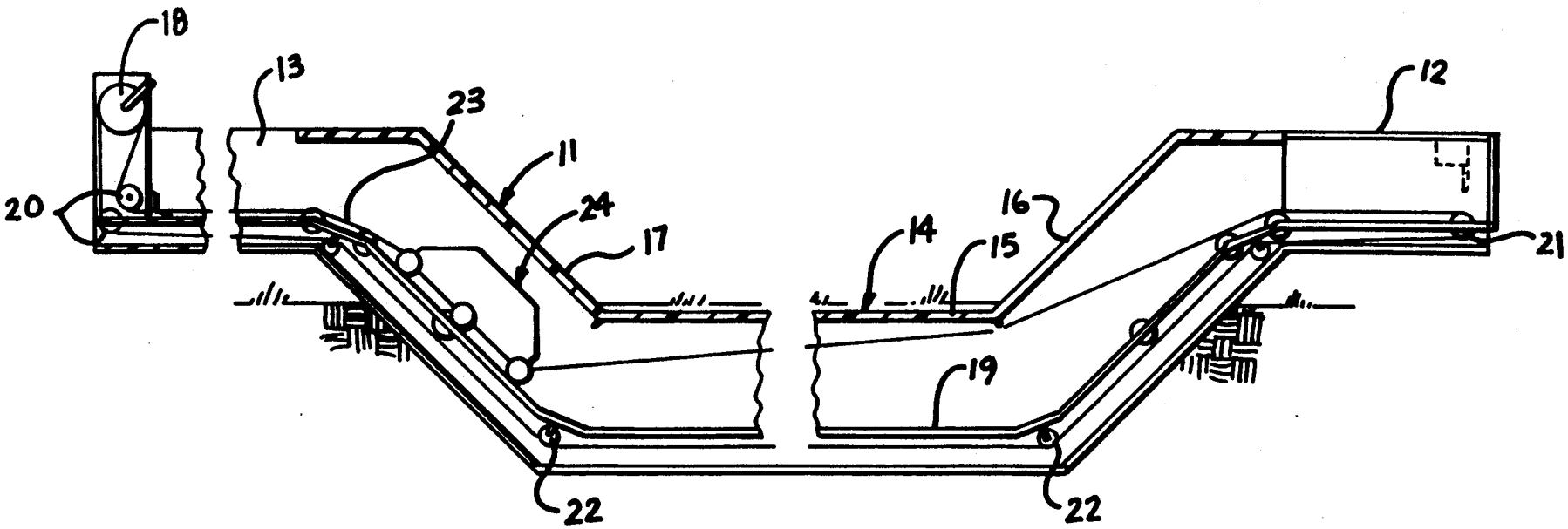
FIG. 2 is an orthographic cross-sectional illustration of the invention.

With reference now to the drawings, and in particular to FIGS. 1 to 7 thereof, a new and improved mailbox apparatus embodying the principles and concepts of the present invention and generally designated by the reference numeral 10 will be described.

Figure 3:
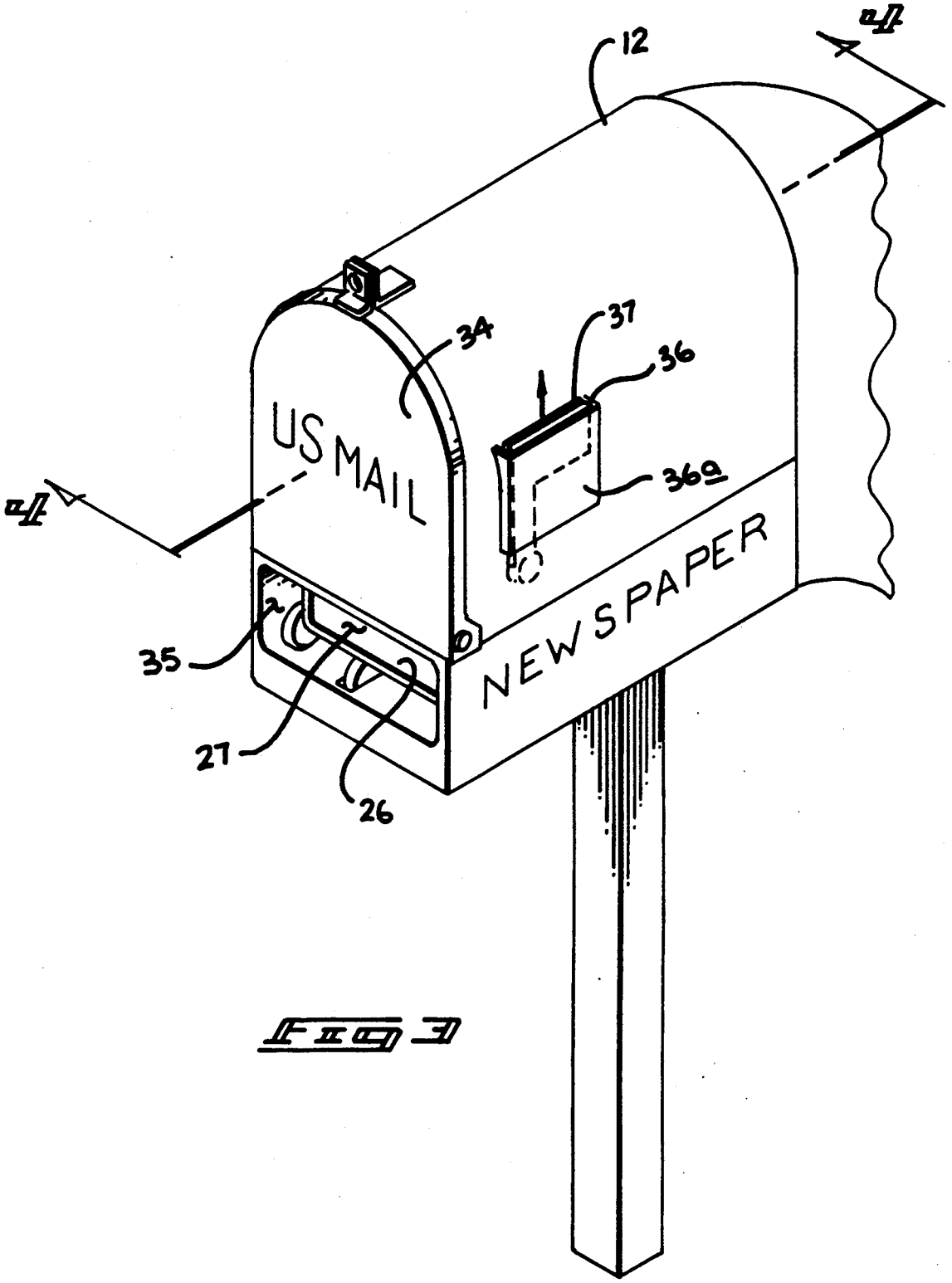
FIG. 3 is an isometric illustration of the forward section of the mailbox delivery conduit.
Figure 5:
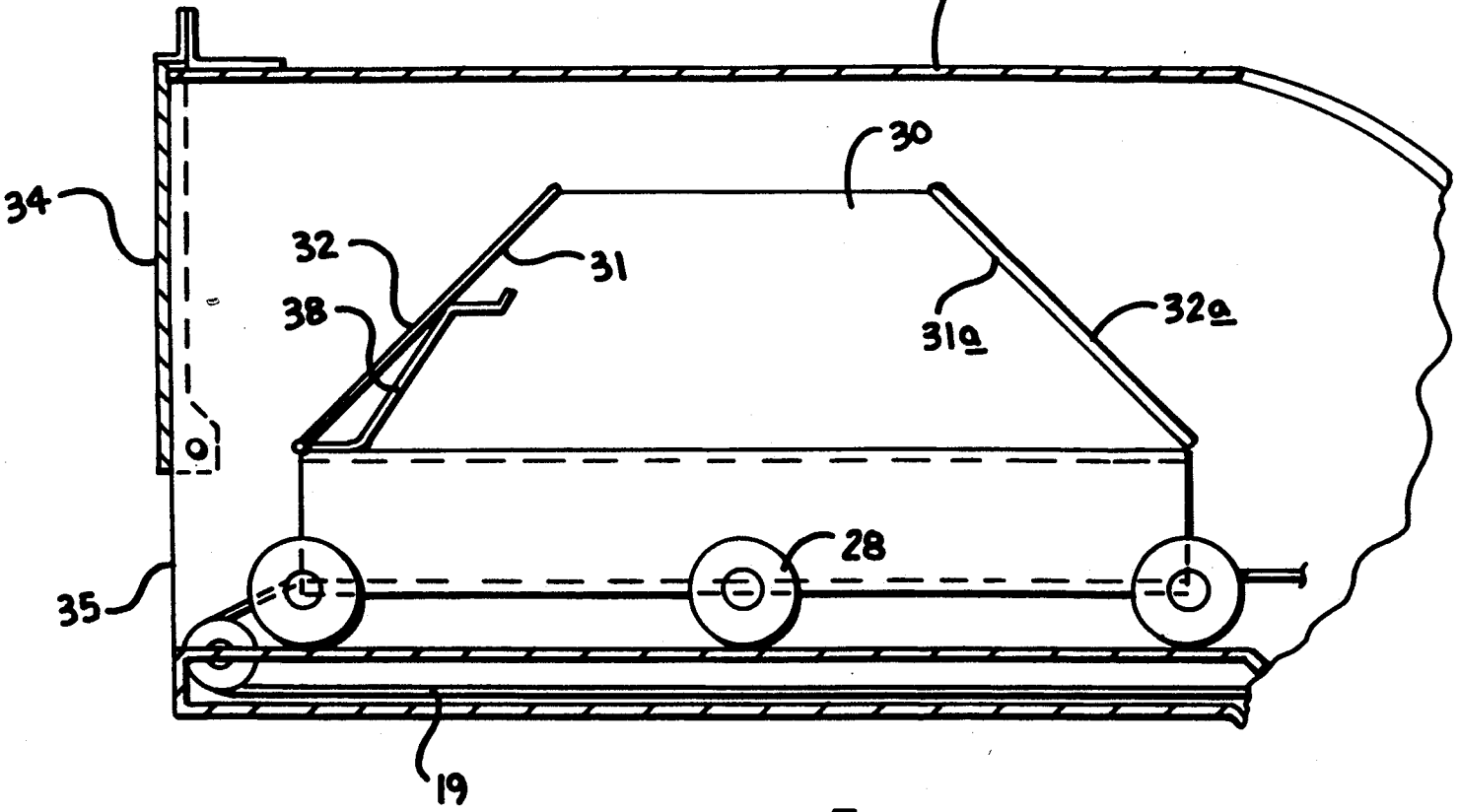
FIG. 5 is an isometric illustration of the vehicle member.
Figure 5:
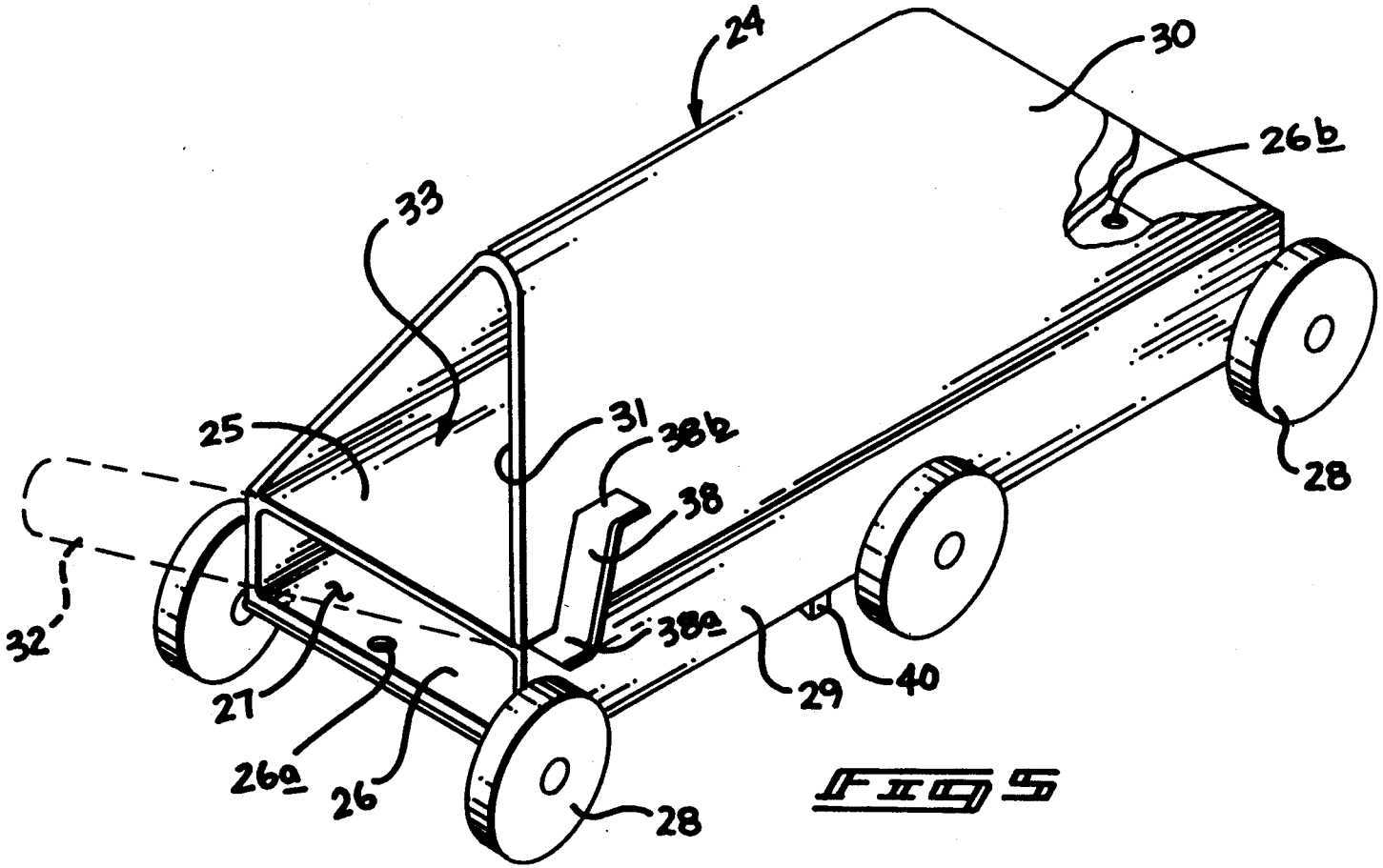
Figure 6:
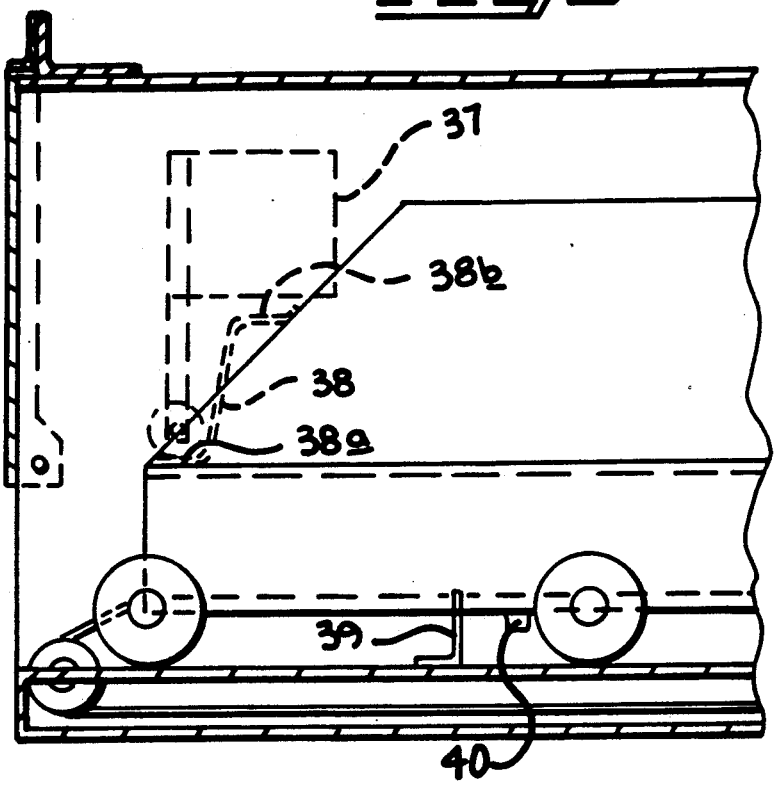
FIG. 6 is an orthographic cross-sectional illustration of the vehicle in a first position relative to an indicator flag.
Figure 7:
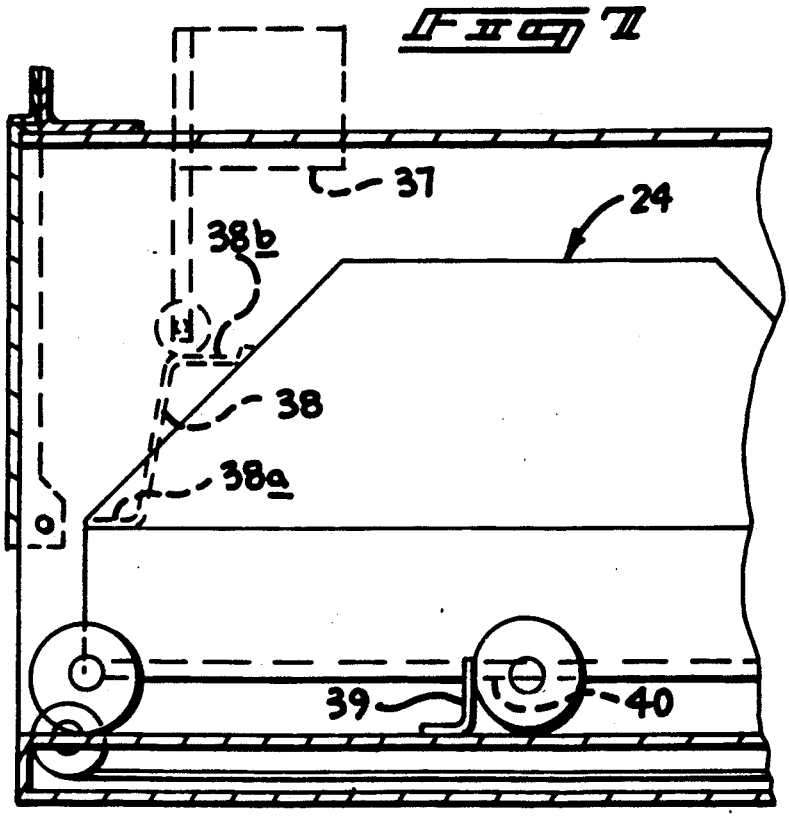
FIG. 7 is an orthographic cross-sectional illustration of the delivery vehicle in a second orientation relative to the indicator flag.

More specifically, the mailbox apparatus 10 of the instant invention essentially comprises an elongate delivery conduit member 11 extending from a dwelling to a remote orientation relative thereto, that includes a first forward section 12 that is aligned with a second rear section 13, with a third "U" shaped central section 14 positioned below and in many instances, below ground level to mask positioning of the conduit member. The central section 14 includes a base conduit 15, with a forward conduit 16 and a rear conduit 17 oriented at obtuse included angles therebetween, wherein idler pulleys are mounted at upper interior surfaces of the base conduit 15 with the forward and rear conduits 16 and 17. A drive pulley 18 is mounted adjacent the rear section 13 operative with rear driven pulleys 20 and forward driven pulleys 21 mounted within the rear and forward sections 13 and 12 respectively. Idler pulleys 22 are spaced at predetermined intervals below the track 22, while the drive pulleys are mounted in alignment with or above the guide track 19. The vehicle member 24 is mounted on the track utilizing various track followers to maintain the vehicle member in association with the track 19. A drive belt 23 is wound about the drive pulley 18, as well as the driven pulleys 20 and 21, and cooperative with the idler pulleys 22 to effect reciprocation of the vehicle member 24 within the conduit member 11. To this extent, the vehicle member includes a top base plate 25 (see FIG. 5) spaced from a bottom base plate 26. The bottom base plate 26 includes respective front and rear edges, with a respective front and rear aperture **26*a* and 26*b* mounted within the bottom base plate adjacent the front and rear edges, wherein the front and rear apertures each receive respective terminal end of the drive belt 23 to provide a continuous connection of the drive belt with the vehicle member to effect its reciprocation upon rotation of the drive pulley 18. The drive pulley 18 may be rotated manually or through other well known means, such as electric motors and the like. The vehicle member 24 includes a newspaper receiving cavity 27 defined between top and bottom base plates 25 and 26 between the spaced side walls 29. Guide wheels 28 are rotatably mounted relative to the bottom base plate 26 for rotatably mounting the vehicle relative to the guide track 19. A vehicle hood 30 extends coextensively above the top base plate 25 to define a mail receiving cavity 33 therewithin. A respective front and rear door may optionally be provided to overlie the front entrance 31 and the rear entrance 31*a* that are hingedly mounted relative to the top base plate to ensure securement of mail within the mail receiving cavity 33. The first section 12 includes a first section door pivotally mounted relative to a forward end of the first section and aligned with the mail receiving cavity 33 when the vehicle is positioned adjacent the first section door 34, as illustrated in FIGS. 3, 6, and 7. A front wall opening 35 below the first section door 34 is aligned with the newspaper receiving cavity 27 when the vehicle member is positioned, as illustrated in the FIGS. 3, 6 and 7. An indicator slot 36 defined by indicator pocket 36*a* reciprocatably mounts an indicator flag 37 therewithin. The indicator flag 37 includes a lower terminal end that cooperates with a cam plate 38. The cam plate 38 is mounted adjacent a side wall of the vehicle member 24 and includes a lower step 38*a* and an upper step 38*b*. An abutment flange 39 mounted upon the track 19 is cooperative with an abutment plug 40 mounted to a bottom surface of the vehicle bottom plate 26. When the abutment plug 40 is in abutment with the abutment flange 39, the lower terminal end of the flag 37 rides up the "S" shaped cam plate 38 for mounting upon the upper step 38*b* to project the flag from the associated pocket 36*a* through the slot 36. This provides visual indication of the vehicle properly positioned relative to the forward conduit member 12 to provide indication for a mail carrier to remove mail from the vehicle member 24. Slight rearward retraction of the vehicle relative to the abutment flange 39** permits descent of the flag.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A mailbox apparatus comprising, a delivery conduit member, the delivery conduit member defining a first forward section spaced from a rear second section, with a third central "U" shaped section mounted between and below the first and second sections, and a drive pulley mounted adjacent the rear section, and a guide track extending coextensively throughout the conduit member, with the drive pulley cooperative with spaced driven pulleys mounted in cooperation with the guide track and the drive pulley, and a drive belt wound about the drive pulley and driven pulleys, with the drive belt including a forward end and a rear end, and a vehicle member movably mounted on the guide track, with the vehicle member including a bottom base plate, the bottom base plate including a front edge aperture mounted to the drive belt forward end, and a rear edge aperture through the bottom base plate mounted to the drive belt rear end, and relative rotation of the drive pulley effects reciprocation of the vehicle member throughout the guide track.

2. An apparatus as set forth in claim 1 wherein the vehicle member includes a top base plate spaced above and coextensive with the bottom base plate, and a newspaper receiving cavity defined between the top base plate and the bottom base plate, and a vehicle hood mounted above and coextensive with the top base plate defining a mail receiving cavity between the vehicle hood and the top base plate, and the top base plate and the vehicle hood including a front entrance and a rear entrance positioned adjacent the vehicle front edge and the vehicle rear edge, and a front entrance door pivotally mounted to the top base plate to selectively overlie the front entrance, and a rear entrance door pivotally mounted to the top base plate to selectively overlie the rear entrance.

3. An apparatus as set forth in claim 2 wherein the first forward section includes a forward section forward end, wherein the forward end is positioned at a forward terminal end of the first section, and the forward end includes a first section door aligned with the mail receiving cavity when the vehicle member is positioned adjacent the forward end, and the forward end further including a front wall opening below the first section door aligned with the newspaper receiving cavity when the vehicle member is positioned adjacent the forward end of the first forward section.

4. An apparatus as set forth in claim 3 wherein the forward section includes an indicator pocket, the indicator pocket including a slot and an indicator flag slidably and reciprocatably mounted within the slot, and the indicator flag including a flag lower terminal end, and an "S" shaped cam plate mounted to the vehicle member, including a lower step spaced from and below an upper step, and the bottom base plate including an abutment plug, and the guide track including an abutment flange, and the lower terminal end of the indicator flag arranged to project from the lower step to the upper step when the abutment plug is in contiguous communication with the abutment flange.

* * * * *